US008246229B2

(12) United States Patent
Silder

(10) Patent No.: US 8,246,229 B2
(45) Date of Patent: Aug. 21, 2012

(54) PICTURE LIGHTING MASTER/MUSEUM FRAME PROVIDING NEAR ISOTROPIC ILLUMINATION OF THE ARTWORK

(76) Inventor: Stephen Hilary Silder, Monroe, CT (US)

( * ) Notice: Subject to any disclaimer, the term of this patent is extended or adjusted under 35 U.S.C. 154(b) by 0 days.

(21) Appl. No.: 11/511,068

(22) Filed: Aug. 28, 2006

(65) Prior Publication Data

US 2008/0068829 A1 Mar. 20, 2008

(51) Int. Cl.
*S21V 8/00* (2006.01)

(52) U.S. Cl. ..... 362/569; 362/26; 362/27; 362/615; 362/560; 362/497

(58) Field of Classification Search ..... 362/559, 362/27, 26, 615, 560, 561, 497, 125, 812, 362/569; 40/714–716
See application file for complete search history.

(56) References Cited

U.S. PATENT DOCUMENTS

| | | | | |
|---|---|---|---|---|
| 1,796,694 | A * | 3/1931 | Silva | 40/572 |
| 2,588,545 | A * | 3/1952 | Lawrence | 40/716 |
| 3,318,032 | A * | 5/1967 | Robison et al. | 40/714 |
| 5,555,654 | A * | 9/1996 | Hermann | 40/714 |
| 6,031,468 | A * | 2/2000 | Tsao et al. | 340/908 |
| 6,553,704 | B1 * | 4/2003 | Pigg | 40/734 |
| 6,681,509 | B1 * | 1/2004 | Jean | 40/443 |
| 7,080,918 | B2 * | 7/2006 | Rowland et al. | 362/125 |
| 7,086,758 | B2 * | 8/2006 | Janning | 362/252 |
| 7,146,760 | B2 * | 12/2006 | Yiu | 40/743 |
| 7,172,324 | B2 * | 2/2007 | Wu et al. | 362/559 |
| 7,186,015 | B2 * | 3/2007 | Kimmet et al. | 362/630 |
| 2004/0226209 | A1 * | 11/2004 | Ayala | 40/714 |
| 2005/0237700 | A1 * | 10/2005 | Thompson | 361/659 |

* cited by examiner

*Primary Examiner* — Jong-Suk (James) Lee
*Assistant Examiner* — Mark Tsidulko
(74) *Attorney, Agent, or Firm* — Ohlandt, Greeley, Ruggiero & Perle, L.L.P.

(57) ABSTRACT

A master/museum picture frame containing integral lighting and a light director (FIG. 1) in accordance with Snell's law of Total Internal Reflection and Refraction By a Prism. Said lights, wired in series with a resistance wire parallel to the filament on the lights dumet, in accordance with the Shunt Theory, such that if one light burns out the remainder remain lighted, to present the artwork in the most favorable manner for the longest period of time when viewed in a depreciating environment. The master/museum frame is interchangeable, both forward and backward, with the capability of being used as a lighted frame or an unlighted frame by substituting a spacer in place of the light director and vice versa as shown in FIG. 3 and FIG. 4.

13 Claims, 4 Drawing Sheets

α° = 75° ± 15° AS REQUIRED

Figure 1:
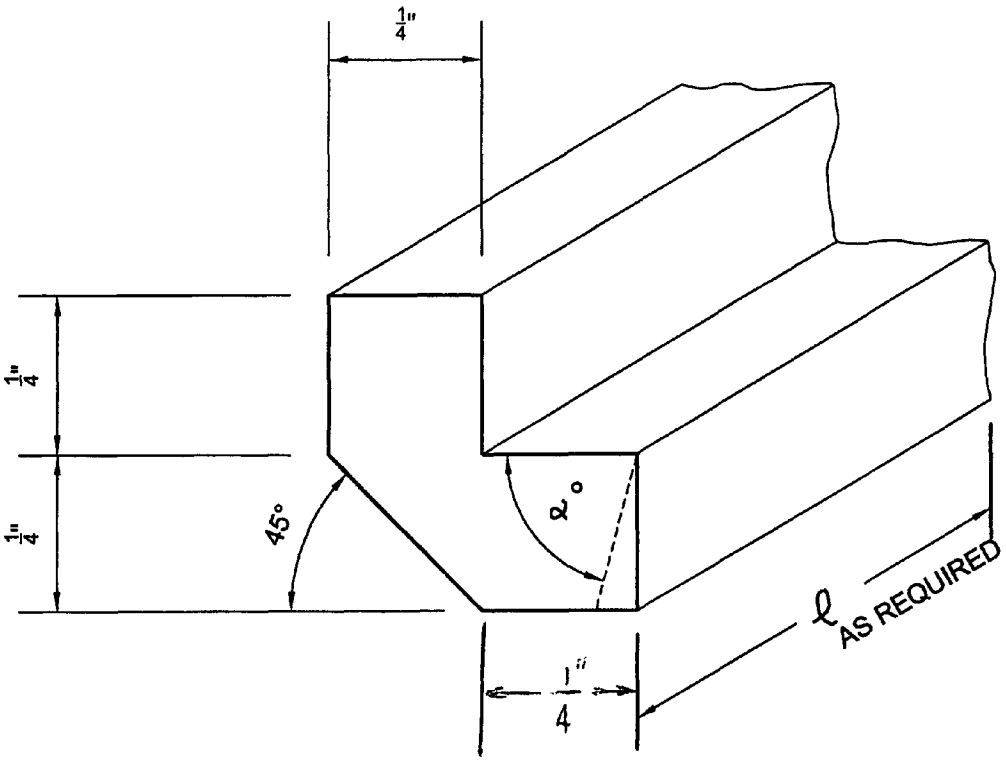

LIGHT DIRECTOR, LUCITE PLEXIGLASS OR OTHER CLEAR MATERIAL $\alpha^{\circ} = 75^{\circ} \pm 15^{\circ}$ AS REQUIRED

LIGHT DIRECTOR, LUCITE PLEXIGLASS OR OTHER CLEAR MATERIAL

REAR VIEW, MASTER / MUSEUM FRAME WITH LIGHT DIRECTOR AND ARTWORK STRETCH FRAME

SECTIONAL VIEW A-A WITH ARTWORK STRETCH FRAME NESTLED ON LIGHT DIRECTOR AND HIGH INTENSITY MINIATURE LIGHT

SECTIONAL VIEW A-A2 WITH ARTWORK STRETCH FRAME NESTLED DIRECTLY ON MUSEUM FRAME

PICTURE LIGHTING MASTER/MUSEUM FRAME PROVIDING NEAR ISOTROPIC ILLUMINATION OF THE ARTWORK

BACKGROUND

1. Field of Invention

This invention relates to artwork illuminating master/museum quality frames to enhance the quality of wall mounted artwork originals and copies when displayed in a less than favorable light environment.

2. Description of Prior Art

Quality artwork in the form of original paintings, lithographic or other copies displayed in the home, office, or other locations are seldom illuminated to present the artwork as favorably as viewed in the art gallery. Impressions made on premium grade paper or premium artists canvas include artists' proofs, gallery proofs, studio proofs, masters' editions and commercial copies, to name a few. Nevertheless, some of the aura and refinement of these quality renditions is lost when viewed outside the gallery. Many galleries, displaying artwork for the consumers' evaluation, have dark walls and no windows to preclude daylight from diminishing the artistic presentation. Often spot. lighting is used to enhance the art, thus displaying it under the most favorable conditions. Further, dimmer controls are often provided to set the lighting on the artwork to the viewers' preference.

When the same artwork is displayed in an ambiance of different lighting conditions such as an office, home or other location, the art loses much of the aura displayed in the gallery. The lighting outside the gallery may have extreme variations upon the artwork both horizontally and vertically thus severely detracting from the intended original artistic rendition. To compensate for this, overhead lights, externally mounted to the frame, are occasionally used to improve the lighting of the artwork. However, this does not provide a uniform field of light and it also detracts somewhat from the artistic rendition intended. Another approach is to use a ceiling mounted spotlight, where practical. This approach throws a large beam of light onto the surrounding area as well as the picture. This is nominally acceptable but does little to restore the aura of the artwork as originally intended.

Inventors have created several types of illuminated picture frame apparatuses. U.S. Pat. No. 5,826,973 to Melzian , et. al. (1998) Describes an illuminated display with uniform luminescence using at least one elongated fluorescent bulb with a plurality of transparent plates arranged between the light source and a housing. Further, Melzian proposes using several transparent plates between which an image is mounted. This is completely contrary to the idea of illuminating quality artwork presented on premium grade paper or premium artists' canvas. Quality artwork is usually framed without any covering glass as exhibited in museums. U.S. Pat. No. 5,247,745 to Valentino (1993) discloses a continuous channel including a plurality of illumination bulbs in electrical communication with a battery and an on/off switch. However, no consideration is given to the power requirements of the plurality of bulbs versus battery capacity and life expectancy or to the circuitry for a greater or lesser number of bulbs. Further, considerable heat may be generated which, over time, can adversely affect the quality of the artwork. No protection is offered against electrical shorting or bulb burnout to effect maximum utilization time between servicing.

Figure 3:
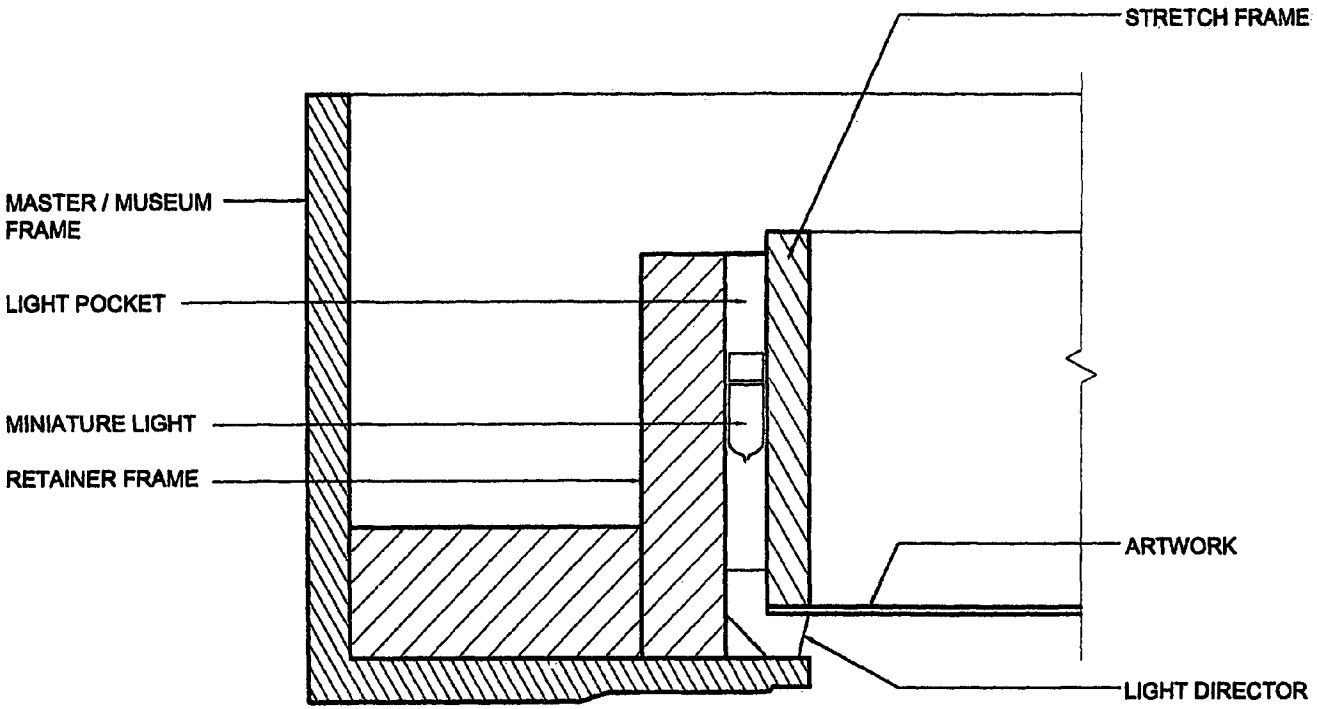

U.S. Patent Application Publication U.S. 2004/02269 A1, Ayala, has a light source(item 20) within the artwork frame (item 10) in front of the artwork (item 40) as shown in FIG. 3 of the application. The heat from the light source in front of the artworkcan have a very deleterious effect upon the artwork over time, while using LED's in the same manner would project an axial beam of light onto the artwork deviating from the original intent.

Ayala's claim 1, third line down, reads . . . at least one light source located in front of the image located within the frame structure . . . .

Ayala's claim 5 reads . . . the light source from claim 1 wherein the light emitting source Is selected from a group consisting of LED'S , incandescent lights . . . etc.

My invention, using high intensity miniature lights places the light source below the artwork in a light pocket between the stretch frame and master/museum frame when the light director is positioned in the frame and the artwork is nestled in the light director.(FIG. 3) The light is projected onto the artwork by the light director. Virtually no heat reaches the artwork from the light director.(FIG. 1)

OBJECTS AND ADVANTAGES

Accordingly, besides the objects and advantages of the artwork lighting master/museum quality frame described in my above patent, several objects and advantages of the present invention are:

a.) To provide artwork lighting from within the master/museum frame interior using TOTAL INTERNAL REFLECTION and REFRACTION BY A PRISM in accordance with Snell's laws of prism physics.

b.) To provide lighting that presents the artwork more closely to the original artistic rendition.

c.) To provide artwork lighting without attaching overhead external lighting d.) To provide lighting which enhances the artwork with minimal thermal energy effects e.) To provide lighting that restores some of the aura and enhances the artistic copy.

f.) To provide lighting using a string of super bright miniature lights g.) To provide safety power cord wiring with replaceable fuses in the plugs h.) To provide series circuit of continuous continuity lights in accordance with the Shunt Theory (if one lamp burns out the remainder stay lit).

i.) To adapt master/museum frames to provide lighting to enhance the artwork or be used without the lighting feature.

Further objects and advantages of my invention will become apparent from a consideration of the drawings and ensuing description.

The Shunt Theory is explained as follows; Inside each lamp there is approximately 3-4 turns of an aluminum wire with an oxide coating wrapped around the dumet wires just above the glass bead. Being coated, the current will take the path of least resistance and thus goes up the dumet wire, through the filament and down the other lead wire. When the filament opens ,there is an instantaneous moment when there is 120V trying to get through the circuit. If there was no shunt the series circuit would remain open and all the lamps in that circuit would not light. However, with the shunt wire present and effectively wound the voltage causes the oxide to breakdown and the current to flow from the dumet through the shunting wire, completing the circuit and once again energizing all the lamps except for the one having the open filament.

Further objects and advantages of my invention will become apparent from a consideration of the drawings and ensuing description.

SUMMARY

In accordance with the present invention, a picture lighting master/museum frame adapted with integral lighting and a light director employing the principle of physics of Snell's law of TOTAL INTERNAL REFLECTION and REFRACTION BY A PRISM to enhance the framed artwork .The frame can be used interchangeably, forward or backward, to frame artwork with or without integral lighting. Forward or backward refers to a single design of frame which can be converted from a non-lighting frame to a lighting frame with minimal modification (removal of a frame spacer and the assembly of a light director in its place along with the ultra-bright miniature lamps to provide lighting).

DRAWINGS

DETAILED DESCRIPTION

Figure 2:
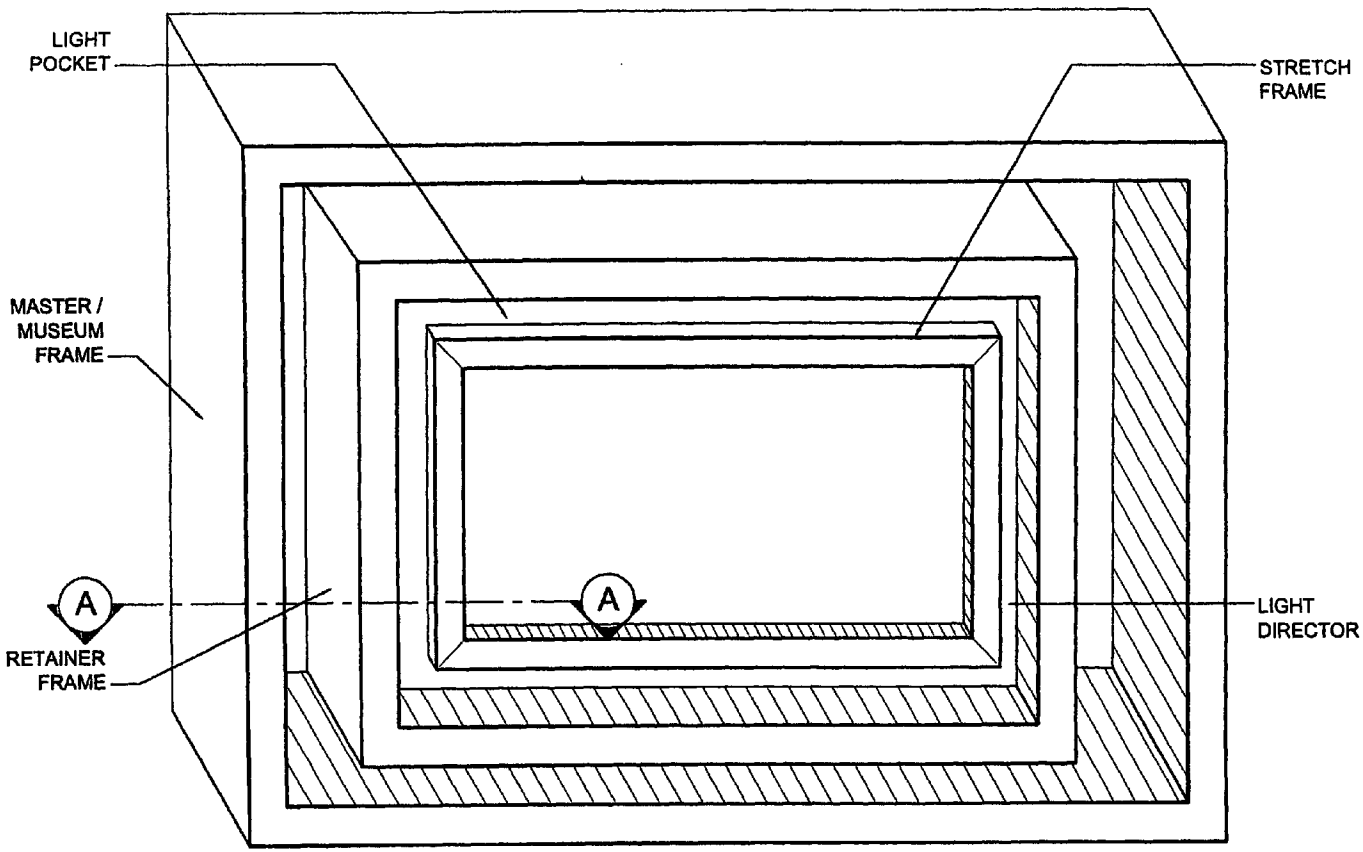
Figure 4:
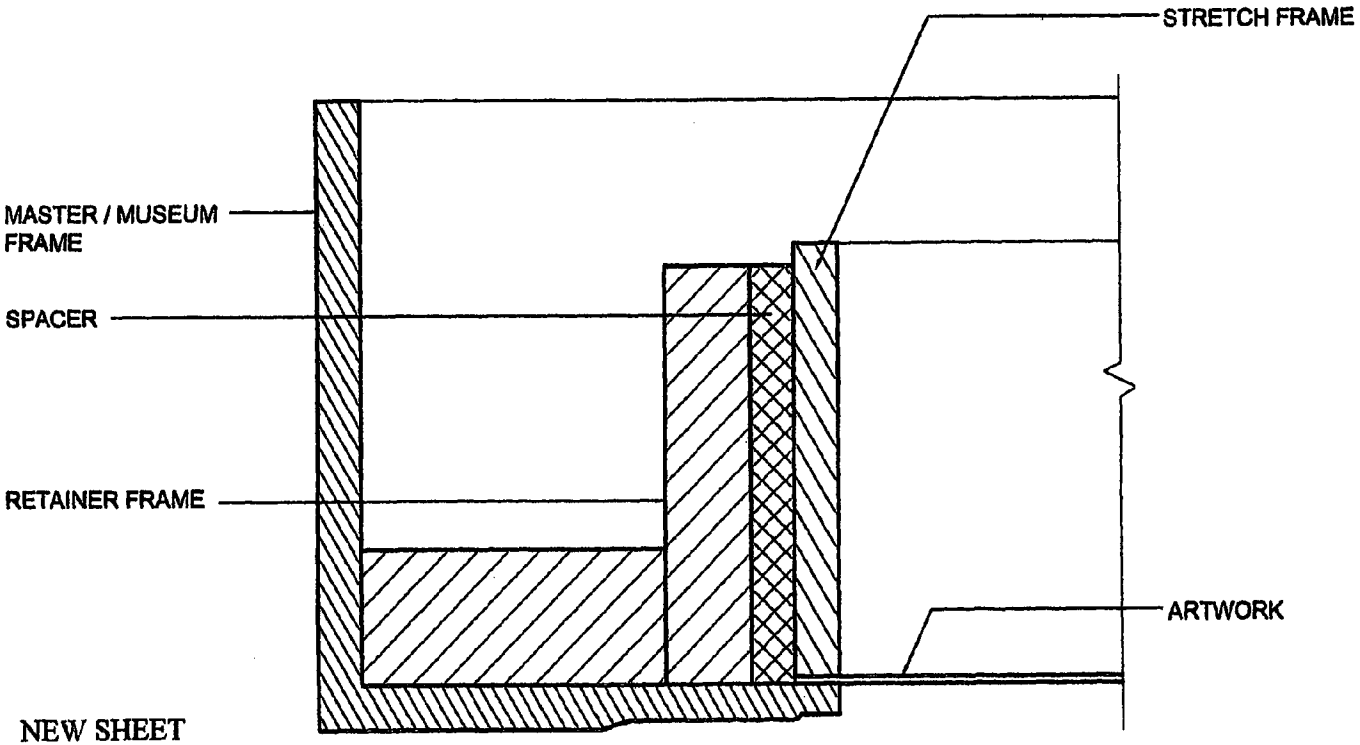

FIG. 1 shows the light director employing the principles of Snell's laws of Total Internal Reflection and Refraction by a prism FIG. 2 is a rear view of the assembly of a picture lighting master/museum frame including the artwork mounted on a stretch frame FIG. 3 shows section view A-A of the final assembly FIG. 4 (NEW) shows section A-AZ the master/museum frame with the artwork mounted with no lighting and without the light director.

PREFERRED EMBODIMENT

A preferred embodiment of the artwork lighting master/museum frame of my invention is illustrated in FIG. 2 and FIG. 3 section A-A. The light director FIG. 1 nestles in the master/museum frame and the stretch frame assembly fits inside the light director. A groove is formed completely around the stretch frame forming a pocket between the retainer frame of the master/museum frame and the stretch frame. The high intensity miniature lights are assembled in the groove typically distributed around the stretch frame as indicated in the table below. A typical support for the string of lights could be insulated staples to secure the lights to the artwork retainer frame at the four corners or free standing. An electrical resistance may be wired in series with the light circuit to
reduce the intensity, if desired, during the time of assembly. The power plug is positioned at the bottom center of said master/museum frame.

| Typical artwork size | vertical | horizontal | | Total |
|---|---|---|---|---|
| 16 inch × 20 inch | 10 | 15 | ×2 | 50 lights |
| 25 inch × 34 inch | 18 | 32 | ×2 | 100 lights |
| 24 inch × 36 inch | 18 | 32 | ×2 | 100 lights |

These are typical sizes. Smaller or larger framed artwork can be lighted either by substituting electrical resistors to control the circuit current where less than 50 lights are needed or by paralleling light series where more than 100 lights are needed. Typical electrical specifications, in addition to the Underwriters Laboratory requirements, for miniature lights are:

a) 50 lights in series approx. 2.5 volts/super-bright miniature light
b) 100 lights made up of two 50 light series strings in parallel
c) Safety power plug with replaceable fuse
d) Continuous continuity lights in accordance with the Shunt Theory (if one light burns out the remainder stay lighted).
e) These are available from the Lighting Division, General Electric Co, as well as other manufacturers. The artwork lighted frame window size of my invention is identical to the artwork window size of the unlighted master/museum frame.

The light director, FIG. 1, may be extruded clear plastic material, such as Lexan or Plexiglas or other similar clear transparent material, even glass, cut to the desired length to fit any size artwork lighting frame. The ends may be cut on a 45 degree angle and cemented together using a Locktite "Stick n Seal" cement or equivalent A typical light bather strip is assembled adjacent to all four sides of the stretch frame and over the light pocket and secured by taping or other mechanical means such as staples. The artwork and stretch frame are secured in place in the artwork window of the master/museum frame by conventional clamps. This is so standard that no further discussion is deemed necessary.

Some quality artwork is mounted on a composition material board or wood. The artwork nestles in the master/museum frame in the same manner as a stretch frame. This type of mounting can be set onto the light director and a dummy stretch frame can secure the artwork in position to be lighted. The dummy stretch frame may be secured to the artwork retainer bar using clamps and screws as referenced above. A light pocket is closed by a barrier strip of cardboard or tape or any similar material, which is assembled to the four sides of the artwork retainer of the master/museum frame and the back of the stretch frame. This is to prevent light leakage to the wall.

The backside of the master/museum frame and artwork assembly may be enclosed with a paper dust backing which is standard to the industry and no further discussion is necessary.

The type of power cord to be used to energize the super-bright miniature lights is determined by the final installation. This cord may be installed at anytime since it is a simple plug in. An outlet in the wall directly behind the artwork controlled by a wall mounted switch dictates the need for a standard extension cord. If no such outlet is available and the power source is a standard wall outlet then an extension cord containing a power switch would be recommended.

ALTERNATE EMBODIMENT

There are various possibilities with regard to the method of securing the super-bright miniature lights such as a flexible plastic light holder sized to fit the length and width dimensions of the light pockets. These could be pre-assembled as required and installed within the light pockets. The identical number of vertical and horizontal lights would be assembled into the light holder with only one slot required through the artwork retainer frame for the power cord. The assembly of the barrier strip and the method of securing would be the same.

Advantages

From the description above, a number of advantages of my picture lighting master/museum frame become evident:

a) Quality artwork can be viewed outside the art gallery with the aura and refinement approximately equal to that in the art gallery.

b) The picture lighting master/museum frame presents the quality artwork in a far superior manner compared to frame mounted overhead lighting.

c) The picture lighting master/museum frame provides the quality artwork with lighting, both day and night, that overcomes the detrimental effects of ambient lighting in the room.

d) Continuous Continuity lights in accordance with the Shunt Theory for the string of super-bright miniature lights ensure that if one light burns out the remainder stay lit ensuring maximum performance life between servicing.

e) The use of miniature super bright light sets wired with safety plugs with replaceable fuses protects the quality artwork and framing.

f) The picture lighting master/museum frame can be used anywhere that provides 115-125V electrical power .The electrical power cord may provide an optional power ON/OFF switch to energize the circuitry of the picture lighting frame, when desired. The power cord is secured by a common clamp and screw to the rear of the master/museum frame retainer frame.

Operation

The manner of using said picture lighting master/museum frame for artwork is basically the same as framing the artwork in a standard, commercial, non-lighted master/museum picture frame. Namely, the standard size commercial quality artwork is interchangeable, forward and backward, using either a master/museum frame or a picture lighting master/museum frame. The difference is that the picture lighting frame contains hidden super-bright miniature lights and a light director system to provide a near isotropic distribution of illumination upon the artwork face when energized. The interior of the frame is designed to accept the light director and the artwork and stretch frame, or board mounted artwork using a dummy stretch frame, as an integral assembly. The external view of the non-lighted master/museum frame and the picture Lighting frame are identical with one exception: the artwork and stretch frame nestled on the light director presents the artwork approximately ¼ of an inch deeper inside the frame window.

The picture lighting master/museum frame contains, in a hidden manner, the super-bright miniature lights which when energized provides lighting which is directed by the light director onto the picture face and restores some of the aura and refinement of the artwork and reduces the detrimental effects of the ambient lighting.

The super-bright miniature lights are assembled into the "light pockets" generated by the artwork retainer frame of the master/museum-frame, the light director and the stretch frame when the stretch frame is installed in the master/museum frame. The power cord and switch assembly are arranged at the bottom center of the retainer frame.

A typical arrangement of lights for a 16×20 inch artwork lighting master/museum frame would dress 8 lights clockwise across the horizontal bottom of the retaining frame, 10 lights vertically on the left, and 7 lights arranged horizontally across the top from the left. Completing the light arrangement would require 7 lights counter-clock wise across the horizontal bottom of the master retaining frame, 10 lights vertically on the right side and 8 lights horizontally across the top from the right side. The lights may be free standing or secured using either insulated staples or by assembly into a simple plastic light holder. Artwork requiring 100 lights or more are routed in a similar manner, with one group of 50 lights dressing clock-wise, the other group of 50 lights dressing counter-clockwise Accordingly, the reader will see that said picture lighting master/museum frame of this invention can restore the aura and refinement of quality artwork when displayed in an ambiance that could severely detract from the intended original artistic rendition. The artwork presentation in the home, office or other location would approach the aura and refinement of the art gallery when viewed in a picture lighting master/museum frame.

Furthermore, said picture lighting master/museum frame has the following additional advantages:

a) It permits lighting from within the frame interior and lights only the artwork face b) Using continuous continuity lights ensures maximum service life, should one light fail the remainder would still continue to be lighted in accordance with the Shunt Theory.

The light director employs a prismatic exit for projecting the light onto the picture face. The angle of the exit face controls the light field on the picture face. Typical exiting angles are 65, 70, 75, 80, or 85, degrees. An angle of 65 degrees would project the light closer to the frame and would be ideal for the smaller master/museum frames. An angle of 85 degrees would be considered for the largest master/museum frame and picture sizes.

I claim:

1. A master/museum picture frame for lighting of artwork placed in the picture frame, comprising:

a master/museum frame;

a retainer frame connected to said master/museum frame;

a light director inside of said master/museum frame;

a stretch frame on which the artwork is mounted, wherein said stretch frame and said artwork are nestled on said light director to form a pocket or groove between said retainer frame and said stretch frame; and a plurality of lights disposed in said pocket behind said light director to provide near isotropic illumination of said artwork displayed in said master/museum frame, wherein said plurality of lights are connected in a series circuit providing continuous continuity so that if one light burns out all other lights of said series circuit will remain lighted to provide lighting for the longest period of time, and whereby said light director, in accordance with Snell's Law of Reflection and Refraction by a prism, projects light from said plurality of lights horizontally across the face of the artwork, thereby restoring some of the aura of the artwork lost due to ambient lighting.

2. The master/museum picture frame of claim 1, wherein said plurality of lights in said internal lighting system contains a series circuit of super-bright miniature lights.

3. The master/museum picture frame of claim 1, wherein said internal lighting system operates directly off a conventional 115-125V AC circuit and is protected by a replaceable fuse in the power cord plug.

4. The master/museum picture frame of claim 1, wherein said internal lighting system eliminates the need for external overhead lighting or spot lighting to illuminate the artwork displayed in said master/museum picture frame.

5. The master/museum picture frame of claim 1, wherein said master/museum picture frame is reversible, forward and backward, with master/museum picture frames without the lighting system for said stretch frame and artwork.

6. The master/museum picture frame of claim 1, wherein said light director comprises a prismatic exit face having an exit angle that controls the projection of light on the artwork.

7. The master/museum picture frame of claim 6, wherein said exit angle is 75°+/−15°.

8. The master/museum picture frame of claim 6, wherein said exit angle is selected from the group consisting of 65°, 70°, 75°, 80°, and 85°.

9. The master/museum picture frame of claim 1, wherein said light director comprises four pieces with ends cut on a 45° angle that are secured together to form a 90° angle, so that said light director directs the light from said plurality of lights onto the artwork face.

10. The master/museum picture frame of claim 1, wherein said plurality of lights and said light director form a lighting system, wherein said lighting system is hidden from view when said master/museum picture frame and artwork are assembled yet provides a near-isotropic distribution of illumination upon the artwork when energized.

11. The master/museum picture frame of claim 1, wherein said plurality of lights are secured to said retainer frame.

12. The master/museum picture frame of claim 1, further comprising an electrical resistor, wherein said electrical resistor is wired in series with said plurality of lights to maintain a proper voltage for said lights.

13. A picture frame assembly for lighting of an artwork disposed therein, said assembly comprising:

an outer frame comprising a first member and a second member, wherein said second member is disposed perpendicular to said first member;

an inner frame;

a stretch frame, wherein said inner frame is disposed between said outer frame and said stretch frame;

a channel formed between opposing surfaces of said inner frame and said stretch frame;

said artwork is disposed perpendicular about an end of said stretch frame directed away from said inner frame;

wherein said second member of said outer frame extends perpendicularly across and in contact with an end of said inner frame and forming a second channel between one end of said artwork and an opposing surface of said second member such that said second member is disposed in front of said artwork, whereas said first channel is disposed parallel to said inner frame which is behind said artwork;

an angular light prism comprising a first portion and a second portion disposed in said first channel and said second channel, respectively; and a plurality of lights disposed in said first channel, such that light illuminating therefrom passes through said first portion of said angular light prism where it reflects into said second portion of said angular light prism such that said light exits said second portion via a prismatic exit face having an exit angle that controls the projection of light on a surface of said artwork, thereby restoring the aura of said artwork typically lost when displayed solely in ambient lighting.

* * * * *